United States Patent [19]

Nilssen

[11] Patent Number: 4,835,413

[45] Date of Patent: May 30, 1989

[54] ELECTRONIC WALL SWITCH ACTUATOR

[76] Inventor: Ole K. Nilssen, Caesar Dr., Barrington Hills, Ill. 60010

[21] Appl. No.: 17,084

[22] Filed: Feb. 20, 1987

Related U.S. Application Data

[63] Continuation-in-part of Ser. No. 719,723, Apr. 4, 1985, Pat. No. 4,645,942.

[51] Int. Cl.[4] ..... H01H 43/00

[52] U.S. Cl. ..... 307/141; 307/140; 200/17 R

[58] Field of Search ..... 307/119, 122, 126, 134, 307/139, 140, 141, 143, 149, 150; 368/246, 247; 200/17 R, 33 R, 33 B, 34, 330, 38 A

[56] References Cited

U.S. PATENT DOCUMENTS

| | | | |
|---|---|---|---|
| 3,527,956 | 9/1970 | Krakinowski | 307/134 |
| 3,985,982 | 10/1976 | Schneidinger | 200/38 A X |
| 3,988,553 | 10/1976 | Astle | 200/33 B X |
| 4,015,139 | 3/1977 | Cleary et al. | 307/141 |
| 4,019,166 | 4/1977 | Lawrence et al. | 200/330 X |
| 4,021,626 | 5/1977 | Becker | 200/33 R |
| 4,259,618 | 3/1981 | Nilssen | 307/140 X |
| 4,430,579 | 2/1984 | Wiktor | 307/134 |
| 4,508,943 | 4/1985 | Pfeiffer et al. | 200/17 R |
| 4,645,942 | 2/1987 | Nilssen | 307/140 |

*Primary Examiner*—Bentsu Ro

[57] ABSTRACT

A self-contained electronic wall switch actuator can easily be mounted directly onto the outside of the face plate of an ordinary wall switch. When so mounted, the actuator engages the wall switch's actuating lever and permits the automatic actuation of the wall switch by way of simple touch action: (i) by lightly pressing a Bypass Key, the wall switch is caused to reverse its state from ON to OFF, or from OFF to ON, whichever is appropriate; (ii) by lightly pressing a Delay Key, the wall switch is caused to enter its ON-state and to remain there for a presetable first period of time; and (iii) by lightly pressing a Cycle Key, the wall switch will, starting right then and repeatedly every 24 hours thereafter, enter its ON-state for a presetable second period of time.

The actuator comprises a small battery, a miniature electric motor with a gear/linkage mechanism operable to engage with and to move the wall switch's actuating lever between its OFF and ON positions, and a quartz-clock-based programming means.

18 Claims, 2 Drawing Sheets

ELECTRONIC WALL SWITCH ACTUATOR

RELATED APPLICATION AND PATENT

The present application is a Continuation-in-Part of Ser. No. 719,723, filed Apr. 4, 1985 now U.S. Pat. No. 4,645,942.

BACKGROUND OF THE INVENTION

1. Field of Invention

The present invention relates to compact light-weight electronic actuator means mountable on the outside of an ordinary wall switch and operable to permit touch-operated timed automatic actuation of the wall switch's actuating lever.

2. Elements of Prior Art

A variety of means for actuating a load from a wall switch have been described in prior art, where they are often referred to as wall switch timers. Examples of such wall switch actuators or timers are described in various U.S. Patents, such as in: U.S. Pat. Nos. 3,179,758 to Trock; 3,491,249 to Rabinow; 3,740,680 to Schneidinger; 3,889,132 to Vreeland; 3,979,601 to Franklin; 3,985,982 to Schneidinger; 4,021,626 to Becker; 4,259,618 to Nilssen; 4,274,045 to Goldstein; 4,344,000 and 4,354,120, both to Schornack; 4,360,739 to Goldstein; and RE 31,848 to Nilssen.

There are two distinctly different types of such actuators or timers. A first type which is mountable on the outside of an already installed ordinary wall switch, as for instance described in U.S. Pat. No. 3,740,680 to Schneidinger, provides for means to turn a light ON (or OFF) for a predetermined time interval (and, optionally, after a predetermined time-delay), but does not provide for repetitive ON/OFF actuations. A second type, as for instance described in U.S. Pat. No. 4,259,618 to Nilssen, does provide for repetitive ON/OFF actuations, but must be wired-in and used in lieu of an ordinary wall switch.

SUMMARY OF THE INVENTION

Problem Situation

For a wall-switch-mountable actuator means to be attractive from a marketing viewpoint, it is important that it be compact, light-of-weight and very easily mountable directly onto the outside of an ordinary wall switch. Also, it is important that its built-in battery last for a long period, preferably several years, before needing replacement.

Prior art, particularly as represented by U.S. Pat. No. 3,740,680 to Schneidinger, describes an actuator means mountable on the outside of an ordinary wall switch and operable to cause timed actuation of the wall switch by automatic physical movement of the wall switch lever.

However, by way of fundamental design limitations, the actuator means of the prior art exhibits the following important characteristics:

(i) The mechanical movement of the wall switch lever is effectuated by way of a direct-acting solenoid. However, for a direct-acting solenoid to be able to provide the required force (about eight ounces) as combined with the degree of movement (about half an inch) required to fully actuate the switch lever of an ordinary modern-day wall switch, it has to be relatively large. In fact, upon experimentation, it was found that the physical size of the solenoid must be very much larger than that of the solenoid illustrated in prior art, particularly as represented by U.S. Pat. No. 3,740,680 to schneidinger.

(ii) As a consequence of the requirements of the solenoid, the power necessary to be supplied from the built-in battery also becomes relatively large—so large, in fact, that the battery has to be of a physical size even larger than that of the solenoid itself, especially if it is to be exhibit a useful length of service life.

(iii) No means have been provided whereby the wall switch lever can be actuated by way of nothing more than a light-touch momentary push of a control key or the like. Rather, if an over-ride action is to be accomplished, it is accomplished by way of direct manual movement of the switch lever.

Key Aspects of the Invention

One key aspect of the present invention is that of recognizing the problem associated with the relatively large physical size fundamentally inherent in prior art designs; which large physical size translates into high cost as well as unattractive product styling.

Another key aspect of the invention is that of providing a solution to the problem of an undesirably large physical size. In particular, the problem is solved by using—in lieu of a solenoid—a low cost commonly available miniature electric motor combined with a simple speed-reducing gear mechanism and a rotational-to-linear movement translator.

These as well as several other important aspects, objects and advantages of the present invention will become apparent from the following description.

BRIEF DESCRIPTION

In its preferred embodiment, subject invention constitutes a self-contained electronic wall switch actuator/timer unit that can easily be (adhesively) mounted directly onto the outside of the face plate of an ordinary wall switch. When so mounted, this actuator/timer unit engages the wall switch's actuating lever and permits the automatic actuation of the wall switch by way of simple touch action.

More particularly: (i) by lightly pressing a Bypass Key, the wall switch is caused to reverse its state from ON to OFF, or from OFF to ON, whichever is appropriate at the moment; (ii) by lightly pressing a Delay Key, the wall switch is caused to enter its ON-state and to remain there for a presetable first period of time; and iii) by lightly pressing a Cycle Key, the wall switch will, starting right then and repeatedly every 24 hours thereafter, enter its ON-state for a presetable second period of time.

The durations of the first and second periods of time are each individually setable by way of a simple slide key.

The actuator/timer unit comprises a small battery, a miniature electric motor with a gear/linkage mechanism operable to engage with and to move the wall switch's actuating lever between its OFF and ON positions, and a quartz-clock-based timing/programming means.

BRIEF DESCRIPTION OF THE DRAWINGS

FIG. 2*a* shows a view predominantly from the rear; and FIG. 2*b* shows a view predominantly from the front.

DESCRIPTION OF THE PREFERRED EMBODIMENT

Details of Construction

Figure 1:
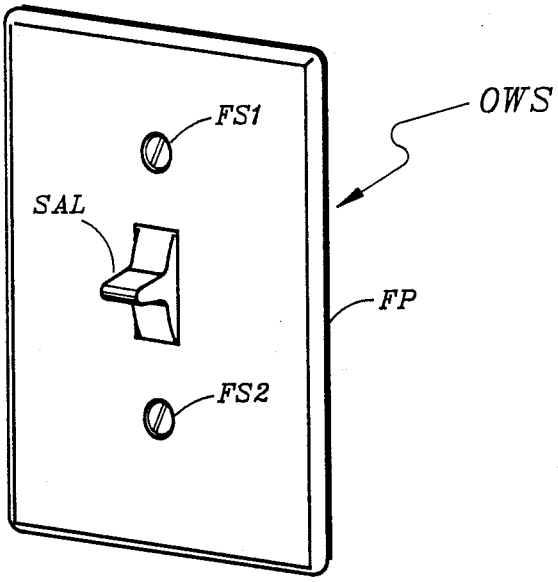
FIG. 1 represents an external view of an ordinary wall switch.

FIG. 1 shows a predominantly frontal view of an ordinary wall switch OWS. This wall switch has a face plate FP, a switch actuating lever SAL and two fastening screws FS1 and FS2.

Figure 2A:
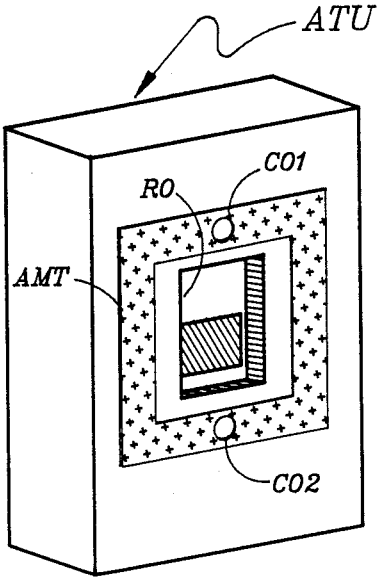
FIGS. 2*a* and 2*b* show subject actuator/timer unit in two perspective views.

FIG. 2*a* shows a view predominantly from the rear of the actuator/timer unit ATU. Positioned substantially in the middle of the rear surface of this actuator/timer unit is a rear opening RO operable to receive switch actuating lever SAL.

Adhesive mounting tape AMT is positioned on the back surface of actuator/timer unit ATU in a substantially rectangular fashion centered around the rear opening RO. Two cut-outs CO1 and CO2 have been provided in the tape so as to allow room for the heads of fastening screws FS1 and FS2 after ATU is mounted onto the faceplate FP of the ordinary wall switch OWS.

Figure 2B:
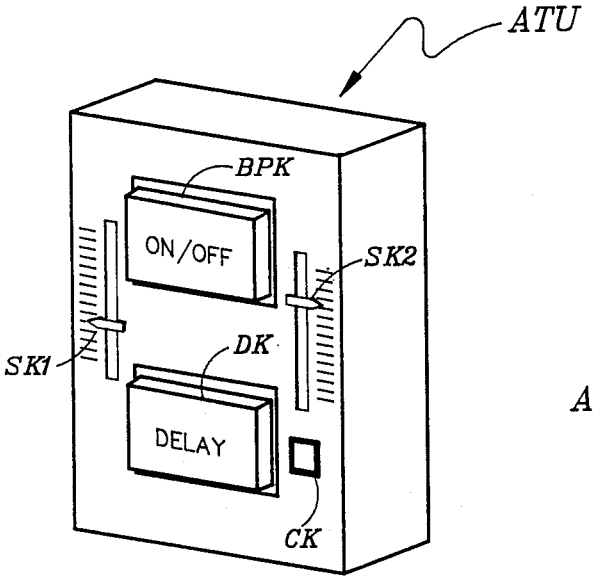

FIG. 2*b* shows a view predominantly from the front of subject actuator/timer unit ATU. Positioned in the middle of the upper part of the front surface is a bypass key BPK marked ON/OFF; and positioned in the middle of the lower part of the front surface is a delay key DK marked DELAY. Near the left edge of the front surface is a first slide key SK1; and near the right edge of the front surface is a second slide key SK2, just below which is a cycle key CK.

Figure 3:
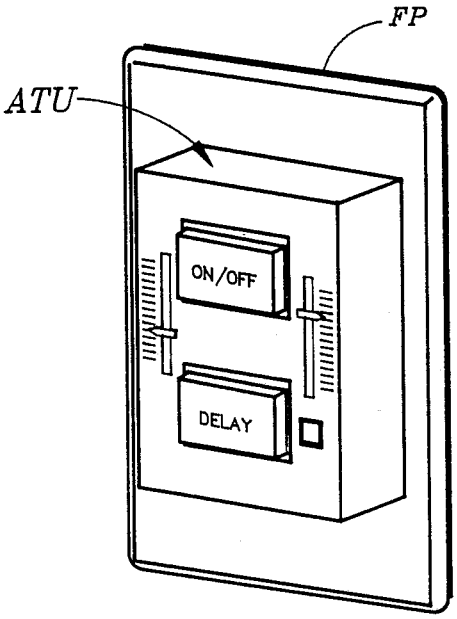
FIG. 3 shows the actuator/timer unit as mounted on an ordinary wall switch.

FIG. 3 shows the actuator/timer unit ATU mounted on an ordinary wall switch OWS, being fastened right onto the face plate FP thereof by way of the adhesive mounting tape AMT.

Figure 4:
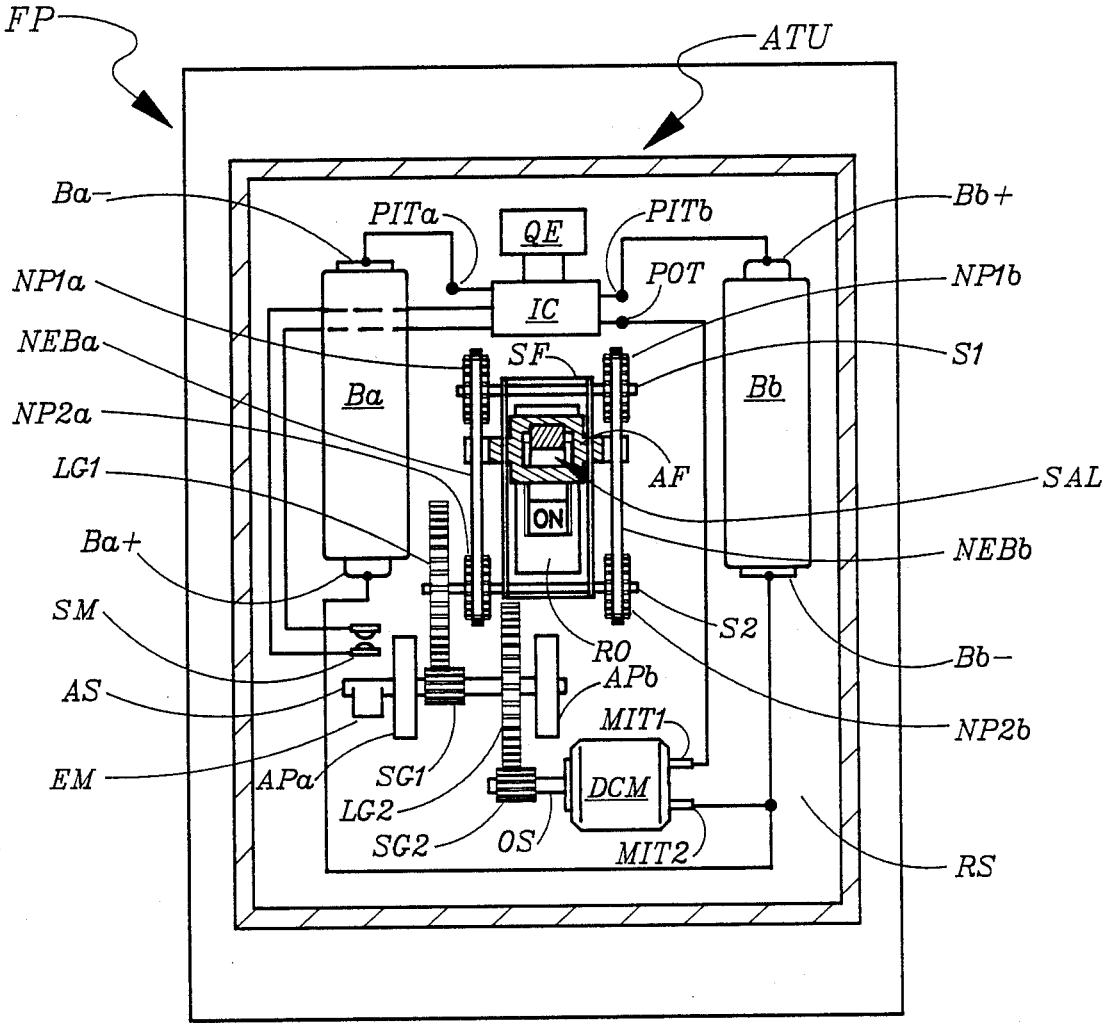
FIG. 4 represents a front view of the key components comprised within the actuator/timer unit.

FIG. 4 shows a schematic frontal view of the inside of actuator/timer unit ATU as mounted onto the fact plate FP of a standard wall switch. Switch actuating lever SAL, which protrudes through rear opening RO, is shown in its ON position.

Surrounding the rear opening and fastened onto the rear surface RS of the actuator/timer unit is a rectangular support frame SF. A first shaft S1 with notched pulleys NP1a and NP1b is supported by this frame near its upper extremity; a second shaft S2 with notched pulleys NP2*a* and NP2*b* is supported by this frame near its lower extremity. Both of these shafts are free to rotate, but are not free to move in any other respects.

A small notched endless belt NEBa connects pulley NP1a with pulley NP2*a*; and a small notched endless belt NEBb similarly connects pulley NP1*b* with pulley NP2*b*. Symmetrically fastened onto both of these endless belts is an actuator frame AF; which frame is so made and positioned as to embrance switch actuating lever SAL. As the actuator frame AF moves, it slides on support frame SF.

Shaft S2 has an extension onto which is mounted a first large gear LG1. An auxiliary shaft AS is rotatably mounted between two auxiliary posts APa and APb; which posts are fastened to the rear surface RS. Mounted onto this auxiliary shaft is a second large gear LG2 and a first small gear SG1. This first small gear SG1 is engaged with the first large gear LG1.

Also mounted onto an extension of this auxiliary shaft AS is an eccentric means EM that operates a preferably bistable switch means SM once for each complete revolution of shaft AS. This switch means has two terminals, both of which are connected with integrated circuit IC.

A small DC motor DCM is mounted on rear surface RS. On the output shaft OS of this DC motor is mounted a second small gear SG2. This second small gear SG2 is engaged with the second large gear LG2. The DC motor has two electrical power input terminals MIT1 and MIT2.

A first battery Ba is positioned on the left hand side of rear surface RS; and a second battery Bb is positioned on the right hand side of rear surface RS. Battery Ba has a Ba− terminal and a Ba+ terminal, with the Ba− terminal being of negative polarity with respect to the Ba+ terminal. Similarly, battery Bb has a Bb− terminal and a Bb+ terminal, with the Bb− terminal being of negative polarity with respect to the Bb+ terminal. The Ba+ terminal is electrically connected with the DC motor's MIT2 terminal as well as with the Bb− terminal.

Integrated circuit IC and a quartz element QE are located near the upper part of the actuator/timer unit. This IC has a number of electrical terminals, most of which are connected with keys BPK, DK, CK, SK1 and SK2, as well as with quartz element QE. However, for sake of clarity, and also since they form no part of the present invention, the detailed electrical connections between the IC and keys BPK, DK, CK, SK1 and SK2 are not shown.

The remaining IC electrical terminals and connections are shown: electrical power input terminal PITa is electrically connected with battery terminal Ba−; electrical power input terminal PITb is electrically connected with battery terminal Bb+; electrical power output terminal POT is electrically connected with motor input terminal MIT1; and the two terminals of switch means SM is connected with two terminals on the IC.

Details of Function and Operation

As indicated in FIG. 3, the size and shape of the overall actuator/timer unit is such as to fit well within the confines of the face plate. To provide for attractive styling, the unit's depth or thickness dimension has been made as shallow as permissible by the size of the switch actuating lever, yet without having the switch lever exposed.

To permit the size and shape of subject actuator/timer unit to be as compact as desired, which degree of compactness is in effect specified by FIG. 3, it is important that the individual components comprised within the actuator/timer unit be fittingly small. In practical reality, this concern is only important in respect to the battery and the motor.

Thus, the electrical power required to be supplied from the built-in battery must be modest enough to permit this battery to be small enough to reasonably fit within the desired specified dimensions of the actuator/timer unit. Similarly, the mechanical power required to be supplied by the built-in motor must be modest enough to permit this motor to be small enough to reasonably fit within the specified dimensions.

Since a certain amount of energy is required to effect actuation of the switch lever, the power required is inversely proportional to the time allowed to effect this actuation. Thus, by way of a speed-reducing gear mechanism, it becomes possible to actuate the switch lever at an arbitrarily small power level.

By allowing complete switch lever actuation, from its extreme ON-position to its extreme OFF-position, to take as long as two seconds from start to finish, the motor power output requirement gets to be acceptably modest; and actuation can then readily be accomplished by way of a substantially conventional miniature DC motor of dimensions no larger than 10 mm×20 mm×20 mm. Correspondingly, the electrical power required by the motor now becomes adequately modest to permit the use of two ordinary AAA-cells for the built-in battery.

In this connection, it is noted that a two-way direct-action solenoid was actually considered but found to be inapplicable as the prime mechanical mover in subject actuator/timer unit for the basic reasons of being far too large in physical size while at the same time requiring more power than could be delivered by a battery of sufficiently small size. The reason a direct-action solenoid requires such a high level of power is related to the fact that such a solenoid has to develop all the required force and distance (energy) in but a single brief stroke—with no feasible way of trading time for power, as can so easily be done with a motor and a gear mechanism.

That is, with a direct-action solenoid, all the required force and movement (energy) has to be produced in a single-stroke electro-magnetic action; which implies a required peak power lever far higher than that resulting when using motoring action (which implies multi-stroke electro-magnetic action) and a speed-reducing gear mechanism.

During the process of actuation, actuator frame AF is apt to slide up and down on the rim of the support frame SF. Also, as the switch lever is being pushed up or down by the actuator frame, there is a degree of sliding between the switch lever and the inner edges of the actuator frame. To minimize power waste, low-friction surfaces have been provided.

Further Details of Operation

With reference to FIG. 4, when the DC motor is provided with a DC voltage across its electrical input terminals, the motor's output shaft will rotate in a direction corresponding to the polarity of this DC voltage.

The rotating motor shaft will, by way of the indicated gear and pulley arrangement, cause the actuator frame to move up or down, thereby causing the switch actuation lever SAL to move correspondingly. With the MIT1 terminal being positive with respect to the MIT2 terminal, the motor shaft rotates in such a direction as to cause the actuator frame to move the switch actuation lever in the down- or OFF-direction, thereby eventually to cause the wall switch to enter its OFF-position.

Correspondingly, with the MIT1 terminal being negative with respect to the MIT2 terminal, the motor shaft rotates in such a direction as to cause the actuator frame to move the switch actuator lever in the up- or ON-direction, thereby eventually to cause the wall switch to enter its ON-position.

In an ordinary wall switch, as the switch actuation lever is slowly pushed from its ON position to its OFF position and after it has reached slightly past the middle position between ON and OFF, a mechanism within the wall switch causes a bi-stable or toggle action to occur. As this occurs, the switch lever—without having to be pushed further—makes a precipitous movement in the direction in which it was being pushed.

To operate properly with some types of wall switches, the opening in the actuator frame should be large enough not to hinder this precipitous onward movement of the switch lever.

With most ordinary wall switches, however, complete ON/OFF control can be achieved without having to move the switch actuation lever all the distance between its extreme ON-position and its extreme OFF-position, which amounts to about 15 mm or about 60 degrees in angle. Rather, complete ON/OFF control can be achieved by making the switch actuation lever move between two positions that corresponds to only about one tenth of that.

Thus, complete ON/OFF control can be effected by moving the switch lever back and forth a distance of only about one sixteenth of one inch. However, the particular position about which this small movement must take place varies with different types of wall switches.

The overall function of the actuator/timer unit involves the programmed actuation by the IC of the DC motor in the one or the other direction, thereby moving the switch lever either up or down to correspondingly turn the switch ON or OFF. The quartz element in combination with the IC acts as an accurate clock, and therefore as an accurate time-base for providing programmable diurnally repetitive ON/OFF actuations of the wall switch.

With reference to FIG. 3, once mounted in its place on an ordinary wall switch, the operation and programming of subject actuator/timer unit may be described as follows.

(i) Whenever it is desired to reverse the state of the wall switch—such as from ON to OFF or vice versa—it is only necessary to press bypass key BPK.

(ii) Whenever it is desired to bring the wall switch into its ON-state for a predetermined length of time, it is only necessary to press delay key DK. The switch will then be actuated into its ON-state and will remain there for a length of time predetermined by the setting of slide key SK1, except if abrogated sooner by action of bypass key BPK.

(iii) Whenever it is desired to program the actuator/timer unit to cause the switch to enter its ON-state for an ON-period of predetermined length each 24 hours, it is only necessary to press cycle key CK at the particular time-of-day when the ON-period is to start. Thereafter, this ON-period will be repeated every 24 hours, until cycle key CK is again pressed. The length of this ON-period is adjusted as desired by slide key SK2. The ON-period can be abrogated at any time, by action of bypass key BPK, without affecting the programming.

Again with reference to FIG. 4, further operational details are provided as follows.

When actuated by bypass key BPK, the IC provides a DC voltage of a first polarity to the DC motor. This DC voltage is provided for as long as it takes for switch means SM to open and close 12 times, which represents a movement of the actuator frame AF that is adequate to make the switch lever move from its one extreme position to its other extreme position, but not for longer than a certain preset time period (typically about two seconds).

If actuated once more by the over-ride or by-pass key (BPK), the IC provides a DC voltage of a second (i.e., opposite) polarity to the DC motor; and again provides this voltage for as long as it takes for the switch means to open and close 12 times, but not for longer than said certain preset time period.

It is to be noted that the actuator frame may be stopped by the switch actuation lever at the end of its allowed travel—thereby, in turn, possibly causing the motor to stall—while the IC is still providing voltage to the motor. However, the magnitude of the current absorbed by the stalled motor is not substantially larger than that of the motor's normal running current.

Alternatively, depending upon the degree of force required to overcome the detent means by which the actuator frame AF is connected with the notched endless belts (which degree of force can be adjusted by design and/or during manufacturing), the motor may continue to run even after the actuator frame has come to a stop.

When actuated by delay key DK, the IC provides a DC voltage of such polarity to the DC motor as to cause it to rotate in such direction as to bring the switch actuation lever to the position where the switch enters its ON-state. Then, after the predetermined time period selected by slide key SK1, the IC provides a voltage of such polarity to the DC motor as to cause it to rotate in such direction as to bring the switch actuation lever to the position where the switch enters its OFF-state.

When actuated by cycle key CK, the IC provides a DC voltage of such polarity to the DC motor as to cause it to rotate in such direction as to bring the switch actuation lever to the position where the switch enters its ON-state. Then, after an ON-period of duration established by the position of slide key SK2, the IC provides a voltage of such polarity to the DC motor as to cause it to rotate in such direction as to bring the switch actuation lever to the position where the switch enters its OFF-state. Thereafter, every 24 hours, the same cycle is repeated until the IC is again actuated (and thereby re-programmed) by cycle key CK. At any time, however, the duration of the ON-period may be changed by adjusting the position of slide key SK2.

Additional Explanations and Comments (a) It is not necessary to use a center-tapped battery for the proper operation of the actuator/timer unit. A single battery could be used in conjunction with providing for double-pole double-throw switching, either by the IC or by mechanical means actuated in accordance with the position of the actuator frame. Or, as yet another alternative, it would be possible to use a single battery in combination with a three-terminal motor.

(b) One important requirement of the actuator/timer unit is that it operates quietly. Such is indeed the case with the particular preferred embodiment presented. However, an adequate degree of quietness would not be easy to achieve by way of a single-stroke solenoid.

(c) Especially in foreign countries, other than the herein described ordinary wall switches are commonly used; and even with the United States different types of wall switches are occasionally used. However, it is a straight forward matter to apply the teachings herein provided to make actuator/timer units that work effectively with such other types of wall switches.

(d) The length of the slot in the actuator frame AF through which the switch lever protrudes may be chosen either to be more-or-less just long enough to accept the largest anticipated switch lever, or it may be chosen to be so long as to permit the toggle action of the switch lever to take place without impediment. The width of the slot is of relatively minor concern as long as it is sufficiently wide to permit easy insertion of the switch actuation lever.

For most applications, it is anticipated that the slot be just long enough to accomodate the switch actuation lever.

(e) The term "ordinary wall switch" refers to the type of wall switch depicted by FIG. 1; which type of wall switch has a switch actuation lever adapted to be stably positioned in either of two distinct positions: an ON-position and an OFF-position. The switch lever may be moved, and/or it may be held still at any point, between these two positions. When gradually pushing the lever from one of these positions toward the other, a point is normally reached where the lever will, if not restrained, continue to move by itself in the direction in which it was being pushed.

(f) The term "programmable", as used in connection with subject actuator/timer unit, refers to a characteristic that allows this actuator/timer unit to be so affected or adjusted (i.e., programmed) as to cause it to operate (i.e., to actuate and de-actuate) repeatedly and continuously in accordance with a 24 hour (or other cyclical) time pattern, until such time as it is re-adjusted or re-programmed. Thus, the term "programmable" would not be applicable to an actuator/timer unit that only provides for a strictly limited number of actuations, or that does not permit re-programming of the actuation pattern.

(g) Slide keys SK1 and SK2 actually operate linear potentiometers; which are connected with the IC and operative, by way of their resistance settings, to determine the durations of the ON-times associated with delay key DK and cycle key CK.

(h) Cycle key CK has been made quite small and also such as to be flush with its surrounding actuation of that key; which inadvertant actuation would require reprogramming of the timing of the 24 hour cycle.

(i) It is readily possible, by way of using one or more additional potentiometers, to permit a more complex programming of the ON-period of the 24 hour cycle. For instance, an additional potentiometer could be used for establishing the ON-period associated with cycle key CK to occur before the point in time at which cycle key CK is actuated. that way, the total ON-period will extend to both sides of the point in the 24 hour cycle established by pressing cycle key CK.

(j) It is anticipated that, in certain applications, an additional cycle key be provided, thereby permitting the programming of a second ON-period to occur each 24 hour period.

(k) The IC, in combination with quartz element QE, actually constitutes a clock with a 24 hour basic repetition cycle. By providing an ordinary clock display, time-of-day can readily be provided.

(l) A non-linear (quasi logarithmic) calibration scale is provided next to both slide keys (SK1 and SK2), thereby permitting easy and accurate establishment of the desired ON-periods.

(m) Bypass key BPK, delay key DK, and cycle key CK each represents the mechanical actuating portion of a momentary electrical switch.

Thus, the IC responds to the momentary action of an electrical switch means.

(n) For the purpose of mechanically actuating the switch lever of an ordinary wall switch, a very important difference between the use of a single-action solenoid and a motor is that of power requirements: for a given amount of energy required for switch lever actuation, the power required by the solenoid is many times as high as that required by a motor. As a consequence, compared with prior art, two important features of the present invention are: (i) significantly increased battery life for a given situation, and (ii) the ability to operate switch actuation levers requiring much higher forces and/or longer strokes.

(o) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

a wall switch having a face plate and a manually actuatable part operable, on receipt of a mechanical input, to cause the wall switch to change between an ON-state and an OFF-state; and actuator means operative to be positioned onto the face plate and to mechanically engage with the manually actuatable part thereof, the actuator means having:

(a) electric energy source means, (b) electrically responsive actuating means comprising an electric motor, (c) time-keeping means, (d) electric processing means, (e) input means receptive of instructive inputs, and (f) connect means operative to interconnect the electric energy source means, the electrically responsive actuating means, the time-keeping means, the electric processing means, and the input means;

thereby, in response to the instructive inputs, to provide corresponding mechanical inputs to the manually actuatable part of the wall switch.

2. The arrangement of claim 1 wherein the actuator means is operative to provide the mechanical input to the manually actuatable part of the wall switch in such manner as to cause the wall switch to change to its OFF-state a predetermined length of time after it received the mechanical input to cause it to change to its ON-state.

3. The arrangement of claim 2 wherein the input means comprises adjustment means operative to permit adjustment of the predetermined length of time.

4. The arrangement of claim 1 wherein the electric processing means, in response to the instructive inputs, is operative to provide a certain set of mechanical inputs repeatedly for an indefinite period of time.

5. The arrangement of claim 4 wherein the certain set of mechanical inputs is repeated every 24 hours.

6. The arrangement of claim 1 wherein: i) the face plate has a periphery, and ii) the actuator means is comprised within this periphery.

7. The arrangement of claim 1 wherein the actuator means has adhesive means operative to permit adhesive attachment of the actuator means to the face plate.

8. The arrangement of claim 1 wherein the actuator means comprises housing means operative to enclose the electric energy source means, the electrically responsive actuating means, and the connect means, the housing means being of such dimensions as to fit within the outer periphery of the face plate while being comprised within a plane parallel with the face plate and removed from the face plate by not more than about one and one half times the length of the switch actuation lever of an ordinary wall switch.

9. The arrangement of claim 1 wherein: i) the electric energy source means provides a DC voltage, and ii) the time-keeping means is operative to keep accurate time for as long as the magnitude of this DC voltage exceeds a predetermined level.

10. For a wall switch having a face plate and a mechanical input means operable, in response to a mechanical input, to cause the wall switch to change between an OFF-state and an ON-state, the improvement comprising:

electro-mechanical actuation means adapted to be mounted onto the face plate and, when so mounted, to mechanically couple with the mechanical input means, the electro-mechanical actuation means comprising:

electro-mechanical actuation means adapted to be mounted onto the face plate and, when so mounted, to mechanically couple with the mechanical input means, the electro-mechanical actuation means comprising an electric motor and being operative by way of the electric motor, on receipt of an actuating input, to provide the mechanical input, thereby corresponding to control the state of the wall switch; and control means connected with the electro-mechanical actuation means and operative to provide the actuating input.

11. The combination of:

a wall switch having a face plate and a manually actuatable part operative, on receipt of a mechanical input, to cause the wall switch to change between an ON-state and an OFF-state; and actuator means positioned onto the face plate in mechanical engagement with the manually actuatable part thereof, the actuator means comprising:

(a) energy source operative to provide electrical output, (b) electro-mechanical means operative: (i) to engage with said manually actuatable part, and (ii) to provide said mechanical input thereto in response to an electrical input, and (c) electrical circuit: (i) connected between the energy source and the electro-mechanical means, and (ii) having control key means operative to receive momentary input of physical pressure and, in response thereto, to cause the electrical circuit to provide electrical connection between the energy source and the electro-mechanical means, thereby to cause the wall switch to change between its ON-state and its OFF-state.

12. The combination of claim 11 wherein the electrical circuit also has delay means operative to cause the wall switch automatically to enter its OFF-state a predetermined period of time after having been caused to enter its ON-state.

13. The combination of claim 12 wherein the electrical circuit additionally comprises manual adjustment means operative to permit adjustment of the length of the predetermined period of time, the manual adjustment means being mechanically separate from the control key means.

14. The combination of claim 11 wherein the electromechanical means comprises a DC motor.

15. An arrangement comprising:

mechanical structure means;

electric motor means having rotatable motor shaft and electric motor terminals, the electric motor being mounted in substantially rigid relationship with the mechanical structure means;

speed conversion means mechanically connected with the motor shaft and operative to provide rectilinear motion at a mechanical output in response to rotational motion by the motor shaft;

mechanical receptacle means connected with the mechanical output of the speed conversion means and operative to receive the switch actuation lever of an ordinary wall switch;

electric battery means supported by the mechanical structure means;

electric circuit means supported by the mechanical structure means and connected between the electric battery means and the electric motor terminals, the electric circuit means having input means receptive of instructional input; and mounting means operative to permit mounting of the mechanical structure means onto the face plate of said ordinary wall switch in such manner that the switch actuation lever engages with the mechanical receptacle means, thereby permitting the movement of the switch actuation lever responsive to said instructional input.

16. The arrangement of claim 15 wherein the electric circuit means has clock and programming means operative to permit the instructional input to be accepted in the form of a time-dependent program, thereby to cause the movement of the switch actuation lever in accordance with such time-dependent program.

17. For a wall switch means operable to exist either in an ON-state or in an OFF-state, the improvement comprising:

control means connected within the wall switch means and operative, on receipt of an electrical control input, to cause the wall switch means: (i) to change from its OFF-state to its ON-state, and (ii) after a predetermined time period, to change back to its OFF-state;

programming means: (i) having a first and a second mechanically responsive input means, (ii) being connected with the control means, (iii) being operative, in response to actuation of the first input means, to provide the electrical control input, and (iv) being operative, in response to mechanical positioning of the second input means, to determine the length of the predetermined time period; and clock means connected with the control means and operative to cause the wall switch means, in a repeated cyclical manner, to change: (i) from its OFF-state to its ON-state, and (ii) after said predetermined time period, back to its OFF-state.

18. For a wall switch operable, in response to the position of a mechanical input means, to exist alternatively in the states of ON and OFF, the improvement comprising:

actuation means mechanically coupled with the mechanical input means and operative, on receipt of an electrical control input, to move the mechanical input means such as to cause the wall switch to controllably change from its OFF-state to its ON-state, and vice versa; the actuation means comprising an electric battery and an electric motor; which, in combination, are operative to cause movement of the mechanical input means; and housing means operative to contain: (i) the actuation means, and (ii) the mechanical input means.

* * * * *